US010708697B2

(12) United States Patent
Pinto

(10) Patent No.: US 10,708,697 B2
(45) Date of Patent: Jul. 7, 2020

(54) HEARING AID WITH AN ANTENNA

(71) Applicant: GN HEARING A/S, Ballerup (DK)

(72) Inventor: Alexandre Pinto, Copenhagen (DK)

(73) Assignee: GN HEARING A/S, Ballerup (DK)

( * ) Notice: Subject to any disclaimer, the term of this patent is extended or adjusted under 35 U.S.C. 154(b) by 0 days.

(21) Appl. No.: 16/504,091

(22) Filed: Jul. 5, 2019

(65) Prior Publication Data

US 2019/0327569 A1 Oct. 24, 2019

Related U.S. Application Data

(63) Continuation of application No. 14/461,983, filed on Aug. 18, 2014.

(30) Foreign Application Priority Data

Aug. 15, 2014 (DK) ..... 2014 70489
Aug. 15, 2014 (EP) ..... 14181165

(51) Int. Cl.
*H04R 25/00* (2006.01)
*H01Q 1/27* (2006.01)
*H01Q 9/42* (2006.01)
*H01Q 9/40* (2006.01)

(52) U.S. Cl.
CPC ..... *H04R 25/554* (2013.01); *H01Q 1/273* (2013.01); *H01Q 9/40* (2013.01); *H01Q 9/42* (2013.01); *H04R 2225/51* (2013.01)

(58) Field of Classification Search
CPC ... H04R 25/554; H04R 25/60; H04R 2225/51
See application file for complete search history.

(56) References Cited

U.S. PATENT DOCUMENTS 6,911,944 B2 * 6/2005 Sekine ..... H01Q 1/243 343/700 MS
10,051,386 B2 * 8/2018 Pinto ..... H01Q 7/00
2002/0041256 A1 * 4/2002 Saitou ..... H01Q 1/362 343/702
2003/0098812 A1 * 5/2003 Ying ..... H01Q 1/243 343/702
2004/0196996 A1 * 10/2004 Feitel ..... H04R 25/65 381/322
2009/0214064 A1 * 8/2009 Wu ..... H04R 25/554 381/315
2010/0158293 A1 * 6/2010 Polinske ..... H01Q 1/243 381/315

(Continued)

*Primary Examiner* — Matthew A Eason
(74) *Attorney, Agent, or Firm* — Vista IP Law Group, LLP

(57) ABSTRACT

A hearing aid includes an assembly, the assembly comprising: a microphone for reception of sound and conversion of the received sound into a corresponding first audio signal; a signal processor configured to provide a second audio signal compensating a hearing loss of a user of the hearing aid, wherein the second audio signal is based on the first audio signal; a wireless communication unit; and an antenna system comprising a first feeding structure and a radiating segment; wherein the first feeding structure is connected or coupled to the wireless communication unit; and wherein at least a part of the first feeding structure is galvanically disconnected from the radiating segment, and is capactively coupled to the radiating segment.

40 Claims, 8 Drawing Sheets

(56) References Cited

U.S. PATENT DOCUMENTS

| | | | | |
|---|---|---|---|---|
| 2010/0158295 | A1* | 6/2010 | Polinske | H01Q 1/243 381/323 |
| 2011/0249836 | A1* | 10/2011 | Solum | H04R 25/558 381/314 |
| 2012/0093324 | A1* | 4/2012 | Sinasi | H04R 25/554 381/23.1 |
| 2012/0326938 | A1* | 12/2012 | Grossman | H01Q 9/30 343/833 |
| 2014/0097993 | A1* | 4/2014 | Hotta | H01Q 1/243 343/702 |
| 2016/0050501 | A1* | 2/2016 | Pinto | H01Q 9/40 381/315 |
| 2016/0360329 | A1* | 12/2016 | Thaysen | H04R 25/65 |
| 2017/0150278 | A1* | 5/2017 | Ruaro | H04R 25/552 |
| 2018/0124528 | A1* | 5/2018 | Polinske | H04R 25/554 |

* cited by examiner

HEARING AID WITH AN ANTENNA

RELATED APPLICATION DATA

This application is a continuation application of U.S. patent application Ser. No. 14/461,983, filed on Aug. 18, 2014, pending, which claims priority to and the benefit of Danish Patent Application No. PA 2014 70489, filed Aug. 15, 2014, and European Patent Application No. 14181165.3, filed Aug. 15, 2014. The entire disclosures of all of the above patent applications are expressly incorporated by reference herein.

TECHNICAL FIELD

The present disclosure relates to a hearing aid having an antenna, the antenna being configured for providing the hearing aid with wireless communication capabilities.

BACKGROUND

Hearing aids are very small and delicate devices and comprise many electronic and metallic components contained in a housing small enough to fit in the ear canal of a human or behind the outer ear. The many electronic and metallic components in combination with the small size of the hearing aid housing impose high design constraints on radio frequency antennas to be used in hearing aids with wireless communication capabilities.

Moreover, the antenna in the hearing aid has to be designed to achieve a satisfactory performance despite the limitation and other design constraints imposed by the size of the hearing aid.

SUMMARY

It is an object to provide a hearing aid with an improved wireless communication capability.

In one aspect of the present disclosure, the above-mentioned and other objects are obtained by provision of a hearing aid comprising an assembly. The assembly comprises: a microphone for reception of sound and conversion of the received sound into a corresponding first audio signal, a signal processor for processing the first audio signal into a second audio signal compensating a hearing loss of a user of the hearing aid, and a wireless communication unit configured for wireless communication. The assembly of the hearing aid comprises an antenna system. The antenna system comprises a first feeding structure and a radiating segment. The first feeding structure is connected or coupled to the wireless communication unit. The radiating segment may be adjacent to at least a part of the first feeding structure. The radiating segment may be galvanic disconnected from at least a part of the first feeding structure.

The first feeding structure may thus exchange energy with the radiating segment through capacitance. The radiating segment may be capacitively coupled to the first feeding structure. The radiating segment may be galvanic disengaged or galvanic separated from at least a part of the first feeding structure.

In one or more embodiments a hearing aid with an antenna system is provided which has an optimized wireless transmission.

The antenna system of the hearing aid according to this disclosure may be excited or fed capacitively, and thus may avoid creating a maximum current magnitude where the antenna is fed, i.e. at a feed point for the antenna. A length of the antenna may thereby be reduced and advantageously placed the confined space of the hearing aid.

At least a part of the first feeding structure may be galvanic disconnected from the radiating segment if a capacitive coupling between the first feeding structure and the radiating segment is within certain limits. For example, the capacitive coupling, such as the capacitance of the capacitive coupling, may be between, 0.5 pF and 20 pF, such as between 0.5 pF and 15 pF, such as between 0.5 pF and 10 pF, such as between 1 pF and 10 pF, such as between 1 pF and 5 pF, between 5 pF and 10 pF, between 0.1 pF and 10 pF, between 0.5 and 5 pF, such as between 0.5 pF and 3 pF, between 5 pF and 20 pF, such as between 7 pF and 20 pF, between 5 pF and 15 pF, between 10 pF and 15 pF, etc. At least a part of the first feeding structure may be galvanic disconnected from the radiating segment if a capacitive coupling between the first feeding structure and the radiating segment is less than 10 pF, such as less than 5 pF, such as less than 2 pF. The capacitive coupling may be larger than 0.1 pF, such as larger than 1 pF, such as larger than 5 pF, etc. The capacitive coupling may be non-zero, so that the capacitive coupling is a non-zero capacitive coupling. The radiating segment may be spaced apart from the at least part of the first feeding structure.

The capacitance of the capacitive coupling may be selected in dependence of the length of the radiating segment.

Thus, in one or more embodiments, the radiating segment may have a length being half a wavelength, such as approximately half a wavelength of an electromagnetic field emitted by the antenna system, such as a length being half a wavelength+/−20% of an electromagnetic field emitted by the antenna system, the capacitive coupling may be selected to be between 0.5 pF and 20 pF, such as preferably selected in the interval between 0.5 pF and 3 pF. In some embodiments, the radiating segment may have a length of more than half a wavelength of an electromagnetic field emitted by the antenna system, such as more than half a wavelength+25% of an electromagnetic field emitted by the antenna system, such as between half a wavelength and a full wavelength, such as between ¾ of a wavelength and a full wavelength of an electromagnetic field emitted by the antenna system, and the capacitive coupling may be selected to be between 0.5 pF and 20 pF, such as preferably between 5 pF and 20 pF, and even more preferred between 5 pF and 18 pF.

At least a part of the first feeding structure may be galvanic disconnected from the radiating segment if the distance between the first feeding structure and the radiating segment is between 0.05 mm and 0.3 mm Thus, the distance may be between 0.1 mm and 0.3 mm, the distance may be larger than 0.05 mm, such as larger than 0.1 mm, the distance may be smaller than 0.5 mm, such as smaller than 0.3 mm.

At least a part of the first feeding structure may be adjacent to and galvanic disconnected from a first end of the radiating segment. The radiating segment may be passively excited proximate a first end of the radiating segment by the at least part of the first feeding structure. The at least part of the first feeding structure and the first end of the radiating segment may be placed proximate each other such that a non-zero capacitance is formed. The first feeding structure and the radiating segment may have a geometry that may enhance the galvanic disconnection between the first feeding structure and the radiating segment.

It is an advantage to tailor the distance between the first feeding structure and the radiating segment according to the geometry of the feeding structure and the radiating segment, respectively. Furthermore, the distance may be tailored according to a desired resonance frequency so that the distance may be a function of resonance frequency for the antenna structure. If for example the geometry of the first feeding structure and/or of the radiating segment and/or the distance between them results in a capacitance that is too low, no currents may be induced in the radiating segment. If the geometry of the first feeding structure and of the radiating segment and/or the distance between them results in a capacitance that is too high, the galvanic disconnection behaves as a galvanic connection and the antenna system may no longer be resonant at the frequency for which it was matched.

The at least part of the first feeding structure may be capacitively coupled to the radiating segment so that the radiating segment may be loaded or fed capacitively by the at least part of the feeding structure. The feeding, coupling or capacitive loading may be optimized with respect to a desired resonance frequency, and the at least part of first feeding structure may be capacitively coupled to the radiating segment over an area of between 1/32 and 1/4 of a wavelength of an electromagnetic field emitted by the antenna system. The radiating segment and the first feeding structure may experience contactless or non-ohmic transmission of energy between them over an area e.g. having a dimension, such as a length, between 1/32 and 1/4 of a wavelength of an electromagnetic field emitted by the antenna system, such as between 1/32 and 1/16 of a wavelength of an electromagnetic field emitted by the antenna system.

The effective length of the radiating segment may be between 1/4 of a wavelength of an electromagnetic field emitted by the antenna system and a full wavelength, such as between 1/4 and 3/4 of a wavelength of an electromagnetic field emitted by the antenna system, such as 1/2 of a wavelength of an electromagnetic field emitted by the antenna system, such as 1/2±20% of a wavelength of an electromagnetic field emitted by the antenna system.

The electromagnetic field emitted by the antenna system corresponds to a desired resonance frequency for the system.

A current flowing into the radiating segment may reach a maximum at a distance from the first end or the second end of 1/4 of a wavelength of the electromagnetic field emitted by the antenna system. The current flowing into the radiating segment may reach a maximum at a midpoint of the radiating segment, such as at a midpoint+/−20%. The midpoint being the point which is halfway between the first end of the radiating structure and a second end of the radiating segment. Such a midpoint of the radiating segment is preferably located at a section of the radiating segment that is normal+/−25 degrees to a surface of a head of a user when the hearing aid is worn in its operational position, such as normal+/−25 degrees to a longitudinal axis of a behind-the-ear type hearing aid, such as parallel+/−25 degrees to a through axis of an in-the-ear type hearing aid or a behind-the-ear hearing aid. When for example the length of the radiating segment is half a wavelength of an electromagnetic field emitted by the antenna system, the midpoint of the radiating segment is 1/4 of a wavelength of the electromagnetic field emitted by the antenna system.

In one or more embodiments, a length of the first feeding structure may be less than 1/4 of a wavelength of an electromagnetic field emitted by the antenna system. For example, the first feeding structure may have a length that is less than 1/4 of a wavelength of an electromagnetic field emitted by the antenna system. For example, the first feeding structure or the length, such as the effective length of the first feeding structure, may be less than 1/8 of a wavelength, or less than 1/16 of a wavelength or less than 1/32 of a wavelength.

In one or more embodiments, a length of the first feeding structure may be between 1/16 of a wavelength and 1/4 of a wavelength of an electromagnetic field emitted by the antenna system. For example, the first feeding structure may have a length that is between 1/16 of a wavelength and 1/4 of a wavelength, such as between 1/8 of a wavelength and 1/4 of a wavelength, or such as between 1/16 of a wavelength and 1/8 of a wavelength.

The radiating segment may be an electrically floating segment. The radiating segment may be e.g. a floating segment in that it is galvanic disconnected from the first feeding structure. The radiating segment is for example galvanic disengaged or separated from the first feeding structure. The radiating segment may not be in ohmic contact with the first feeding structure.

At least a part of the first feeding structure may be provided in a first plane and at least a part of the radiating segment may be provided in a second plane. In one or more embodiments, the first plane is different from the second plane. Alternatively in other embodiments, a part of the first feeding structure and a part of the radiating segment may be co-planar. A part of the first feeding structure and a part of the radiating segment may be co-planar or not as long as there is provided a galvanic disconnection between the first feeding structure and the radiating element with an appropriate capacitance.

The radiating segment may have one free end or two free ends. A current at a free end of the radiating segment is zero.

The hearing aid may be an in-the-ear type hearing aid. The hearing aid may be a behind-the-ear hearing aid.

The in-the-ear type hearing aid has a housing shaped to fit in the ear canal. The in-the-ear type hearing aid comprises a face plate. The face plate or a part of the face plate is typically in a plane orthogonal to an ear axis. A partition axis or a through axis in this type of hearing aid is in a plane orthogonal to a surface of a head of a user, whereas the face plate of the in-the-ear type hearing aid typically is parallel to a surface of a head of a user and thus orthogonal to the partition axis. For an in-the-ear hearing aid, the ear axis may be orthogonal to the face plate or to the plane in which the face plate extends.

The behind-the-ear type of hearing aid typically has an elongated housing most often shaped as a banana to rest on top of the auricle of the ear. The assembly of this type of hearing aid will thus have a longitudinal axis parallel to the surface of the head of the user and orthogonal to the ear axis. Thus, the ear axis for a behind-the-ear hearing aid may be orthogonal to the longitudinal axis of the behind-the-ear hearing aid. A through axis may traverse the behind-the-ear hearing aid along the ear axis, and thus orthogonal to the longitudinal axis of the behind-the-ear hearing aid.

A behind-the-ear hearing aid or an in-the-ear hearing aid assembly may comprise a first side and a second side. The first side may be opposite the second side. The first side of the hearing aid assembly and/or the second side of the hearing aid assembly may extend along a longitudinal axis of the hearing aid. The first side of the hearing aid assembly and/or the second side of the hearing aid assembly may be orthogonal the through axis of the hearing aid. In some embodiments, a first section of the radiating segment may be provided along a first side of the hearing aid assembly. A second section of the radiating segment may be provided along a second side of the hearing aid assembly. A third section of the radiating segment may be connected to the first section in a first end and to a second section in the second end. The third section extends along an axis which is normal+/−25° to the first side and/or the second side of the hearing aid assembly. The third section extends for example along an axis which is normal+/−25° to a surface of a head of a user when the hearing aid is worn in its operational position, the third section may extend along an axis which is parallel+/−25° to the ear axis. In some embodiments, the radiating segment may be provided substantially along a first side of the hearing aid assembly. A part of the radiating segment may be provided along a first side of the hearing aid assembly. The second side may be adjacent the head of a user when the hearing aid is worn in its intended operational position behind the ear.

In an in-the-ear type hearing aid comprising a face plate, a first section of the radiating segment may be provided in a first ITE plane adjacent a face plate of an ITE hearing aid. A second section of the radiating segment may be provided in a second ITE plane. A third section of the radiating segment may be connected to the first section in a first end and to the second section in the second end. A part of the first section is e.g. provided in a plane parallel to the face plate. A part of the second section is e.g. provided in a plane parallel to the face plate. The second ITE plane may be substantially parallel with the first ITE plane. A part of the third section is e.g. provided in a plane orthogonal+/−25 degrees to the face plate. The third section may be provided along an axis which is normal+/−25° to the face plate.

In one or more embodiments, the antenna system may comprise a second feeding structure or a third segment. The second feeding structure may excite the radiating segment proximate a second end. The second feeding structure may be coupled or connected to the wireless communication unit 22 or a ground plane 24. By providing a first and a second feeding structure, the radiating segment may be fed in a first end and a second end, respectively. In some embodiments this may provide a balanced antenna system.

In one or more embodiments, at least a part of the radiating segment is provided at or in a hearing aid shell. In one or more embodiments, at least a part of the radiating segment is provided on an inner or an outer surface of the hearing aid shell. In one or more embodiments, the hearing aid shell is manufactured in a low loss material, such as in a material having a tangient loss of below 0.05, such as below 0.02, such as in a material of plastic, ABS Polycarbonate, PCABS, Zytel, ceramics, etc.

In one or more embodiments, the antenna system may further have a third segment. The third segment may be connected to the wireless communication unit and at least a part of the third segment may be adjacent to and galvanic disconnected from a second end of the radiating segment.

In one or more embodiments, the antenna system may further have a third segment. The third segment may be connected to a ground plane and at least a part of the third segment may be adjacent to and galvanic disconnected from a second end of the radiating segment.

In one or more embodiments, the first feeding structure may be adjacent to and galvanic disconnected from a first end of the radiating segment while the second end of the radiating segment may be grounded. The radiating segment may be construed as a parasitic element since it is connected to a ground plane.

In general, various segments, sections and/or structures of the antenna system may be formed having different geometries, the segments/sections/structures may be wires or patches, bend or straight, long or short as long as they obey the above relative configuration with respect to each other.

In one or more embodiments, the hearing aid comprises a housing. The housing comprises: a microphone for reception of sound and conversion of the received sound into a corresponding first audio signal, a signal processor for processing the first audio signal into a second audio signal compensating a hearing loss of a user of the hearing aid, and a wireless communication unit configured for wireless communication. Thus, the housing may comprise a hearing aid assembly comprising the microphone, the signal processor and the wireless communication unit. The hearing aid, or the assembly of the hearing aid, may comprise an antenna system. The antenna system may thus be accommodated in the housing of the hearing aid. The antenna system comprises a first feeding structure and a radiating segment. The first feeding structure is connected or coupled to the wireless communication unit. The radiating segment may be adjacent to and galvanic disconnected from at least a part of the first feeding structure. At least a part of the first feeding structure may be galvanic disconnected from the radiating segment if a capacitive coupling between the first feeding structure and the radiating segment is within certain limits as described above.

The hearing aid disclosed herein may be configured for operation in ISM frequency band. Preferably, the antenna is configured for operation at a frequency of at least 1 GHz, such as at a frequency between 1.5 GHz and 3 GHz such as at a frequency of 2.4 GHz. Additionally or alternatively, the hearing aid may be configured to operate at a frequency over 3 GHz, such as at a frequency of 5 GHz.

It is an advantage that, during operation, the radiating segment and the first feeding structure contributes to an electromagnetic field that travels around the head of the user, such as more efficiently around the head of a user, thereby providing a wireless data communication that is robust and has low loss. Thus, a wireless data communication between a hearing aid provided at one ear of a user and a hearing aid provided at another ear of a user, e.g. right and left ear of a user, may be improved.

Due to the current component normal to the side of the head or normal to any other body part, the surface wave of the electromagnetic field may be more efficiently excited. Hereby, for example an ear-to-ear path gain may be improved, such as by 10-15 dB, such as by 10-30 dB.

In the following, the embodiments are described primarily with reference to a hearing aid, such as a binaural hearing aid. It is however envisaged that the disclosed features and embodiments may be used individually or in combination in other types of hearing devices. Also, features described herein may be used individually or in combination in any audio systems, such as an audio system that involves communication between a hearing aid and other wireless enabled components.

A hearing aid has an assembly, the assembly comprising: a microphone for reception of sound and conversion of the received sound into a corresponding first audio signal; a signal processor for processing the first audio signal into a second audio signal compensating a hearing loss of a user of the hearing aid; a wireless communication unit configured for wireless communication; and an antenna system comprising a first feeding structure and a radiating segment; wherein the first feeding structure is connected or coupled to the wireless communication unit, and wherein the radiating segment is galvanic disconnected from at least a part of the first feeding structure; and wherein the at least a part of the first feeding structure is galvanic disconnected from the radiating segment if a capacitive coupling between the at least a part of the first feeding structure and the radiating segment is between 0.5 pF and 20 pF.

Optionally, the at least a part of the first feeding structure is galvanic disconnected from the radiating segment if the capacitive coupling between the at least a part of the first feeding structure and the radiating segment is between 0.5 pF and 3 pF.

Optionally, the at least a part of the first feeding structure is galvanic disconnected from the radiating segment if a distance between the at least a part of the first feeding structure and the radiating segment is between 0.05 mm and 0.3 mm.

Optionally, an effective length of the radiating segment is between ¼ of a wavelength and a full wavelength of an electromagnetic field emitted by the antenna system.

Optionally, a current flowing into the radiating segment reaches a maximum at a distance from a first end of ¼ of a wavelength of an electromagnetic field emitted by the antenna system.

Optionally, a length of the first feeding structure is less than ¼ of a wavelength of an electromagnetic field emitted by the antenna system.

Optionally, the radiating segment comprises an electrically floating segment.

Optionally, at least a part of the first feeding structure is in a first plane and wherein at least a part of the radiating segment is in a second plane.

Optionally, the radiating segment has a free end.

Optionally, a first section of the radiating segment is along a first side of the assembly, a second section of the radiating segment is along a second side of the assembly, and a third section of the radiating segment has a first end connected to the first section, and a second end connected to the second section.

Optionally, the hearing aid is an in-the-ear hearing aid, wherein a first section of the radiating segment is in a first in-the-ear plane adjacent a face plate of the in-the-ear hearing aid, wherein a second section of the radiating segment is in a second in-the-ear plane, and wherein a third section of the radiating segment has a first end connected to the first section, and a second end connected to the second section.

Optionally, the third section is along an axis which is normal+/−25° to the face plate.

Optionally, at least a part of the radiating segment is at or in a hearing aid shell.

Optionally, the antenna system further has a segment, the segment being connected to the wireless communication unit, and wherein at least a part of the segment is galvanic disconnected from an end of the radiating segment.

Optionally, the antenna system further has a segment, the segment being connected to a ground plane, and wherein at least a part of the segment is galvanic disconnected from an end of the radiating segment.

A hearing aid includes a housing, the housing comprising: a microphone for reception of sound and conversion of the received sound into a corresponding first audio signal; a signal processor for processing the first audio signal into a second audio signal compensating a hearing loss of a user of the hearing aid; a wireless communication unit configured for wireless communication; and an antenna system comprising a first feeding structure and a radiating segment; wherein the first feeding structure is connected or coupled to the wireless communication unit, and wherein the radiating segment is galvanic disconnected from at least a part of the first feeding structure.

The above and other features and advantages will become more apparent to those of ordinary skill in the art by describing in detail exemplary embodiments thereof with reference to the attached drawings in which:

DETAILED DESCRIPTION OF THE DRAWINGS

Figure 1:
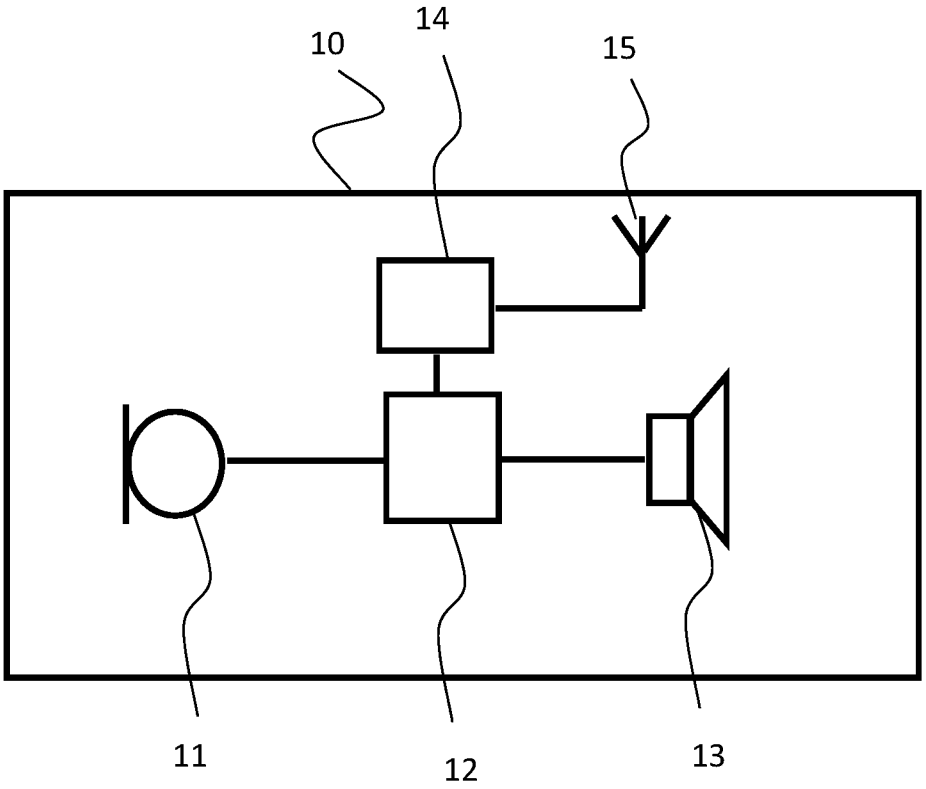
FIG. 1 is a block-diagram of a typical hearing aid.

Various embodiments are described hereinafter with reference to the figures. It should be noted that elements of similar structures or functions are represented by like reference numerals throughout the figures. It should also be noted that the figures are only intended to facilitate the description of the embodiments. They are not intended as an exhaustive description of the claimed invention or as a limitation on the scope of the claimed invention. In addition, an illustrated embodiment needs not have all the aspects or advantages shown. An aspect or an advantage described in conjunction with a particular embodiment is not necessarily limited to that embodiment and can be practiced in any other embodiments even if not so illustrated, or if not so explicitly described.

The embodiments will now be described more fully hereinafter with reference to the accompanying drawings, in which exemplary embodiments are shown. The claimed invention may, however, be embodied in different forms and should not be construed as limited to the embodiments set forth herein.

The term "galvanic disconnected" as used herein refers to the absence of a galvanic connection, the absence of a direct conduction path, e.g. the absence of hardwire between two elements. Elements galvanic disconnected may be galvanic disengaged or separated from one another. Elements galvanic disconnected experience for example contactless transmission of energy between them. Elements galvanic disconnected exchange energy through capacitance. Two elements may be considered galvanic disconnected if a capacitive coupling between them is e.g. between 0.5 pF and 20 pF, such as between 1 pF and 10 pF, such as between 1 pF and 5 pF, etc. Two elements may be considered galvanic disconnected if a distance between them is e.g. between 0.05 mm and 0.3 mm.

The hearing aid may be an in-the-ear type hearing aid. The hearing aid may be a behind-the-ear type of hearing aid. The in-the-ear type hearing aid has a housing shaped to fit in the ear canal. A partition or through axis (such as axis 401 of FIG. 4) in this type of hearing aid is parallel to the ear axis, whereas the face plate of the in-the-ear type hearing aid typically is in a plane orthogonal to the ear axis. In other words, a partition axis in this type of hearing aid is in a plane orthogonal to a surface of a head of a user, whereas the face plate of the in-the-ear type hearing aid typically is parallel to a surface of a head of a user. The behind-the-ear type of hearing aid typically also has an elongated housing most often shaped as a banana to rest on top of the auricle of the ear. The assembly of this type of hearing aid will thus have a longitudinal axis (such as axis 301 of FIG. 3) parallel to the surface of the head of the user and a through axis orthogonal to the longitudinal axis.

FIG. 1 shows a block-diagram of a typical hearing aid. In FIG. 1, the hearing aid 10 comprises a microphone 11 for receiving incoming sound and converting it into an audio signal, i.e. a first audio signal. The first audio signal is provided to a signal processor 12 for processing the first audio signal into a second audio signal compensating a hearing loss of a user of the hearing aid. A receiver, optionally, is connected to an output of the signal processor 12 for converting the second audio signal into an output sound signal, e.g. a signal modified to compensate for a user's hearing impairment, and provides the output sound to a speaker 13. Thus, the hearing instrument signal processor 12 may comprise elements such as amplifiers, compressors and noise reduction systems etc. The hearing aid may further have a feedback loop for optimizing the output signal. The hearing aid comprises a wireless communication unit 14 (e.g. a transceiver) for wireless communication connected with an antenna 15 for emission and reception of an electromagnetic field. The wireless communication unit 14 may connect to the hearing aid signal processor 12 and to the antenna 15, for communicating with e.g. external devices, or with another hearing aid, located at another ear, in a binaural hearing aid system.

The wireless communication unit may be configured for wireless data communication, and in this respect connected with the antenna for emission and/or reception of an electromagnetic field. The wireless communication unit may comprise a transmitter, a receiver, a transmitter-receiver pair, such as a transceiver, a radio unit, etc. The wireless communication unit may be configured for communication using any protocol as known for a person skilled in the art, including Bluetooth, WLAN standards, manufacture specific protocols, such as tailored proximity antenna protocols, such as proprietary protocols, such as low-power wireless communication protocols, etc.

The specific wavelength, and thus the frequency of the emitted electromagnetic field, is of importance when considering communication involving an obstacle. In the present disclosure, the obstacle is a head. The hearing aid comprising an antenna may be located close to the surface of the head or in the ear canal. In general the ear to ear communication may be performed in with a desired frequency centred around 2.4 GHz.

Figure 2:
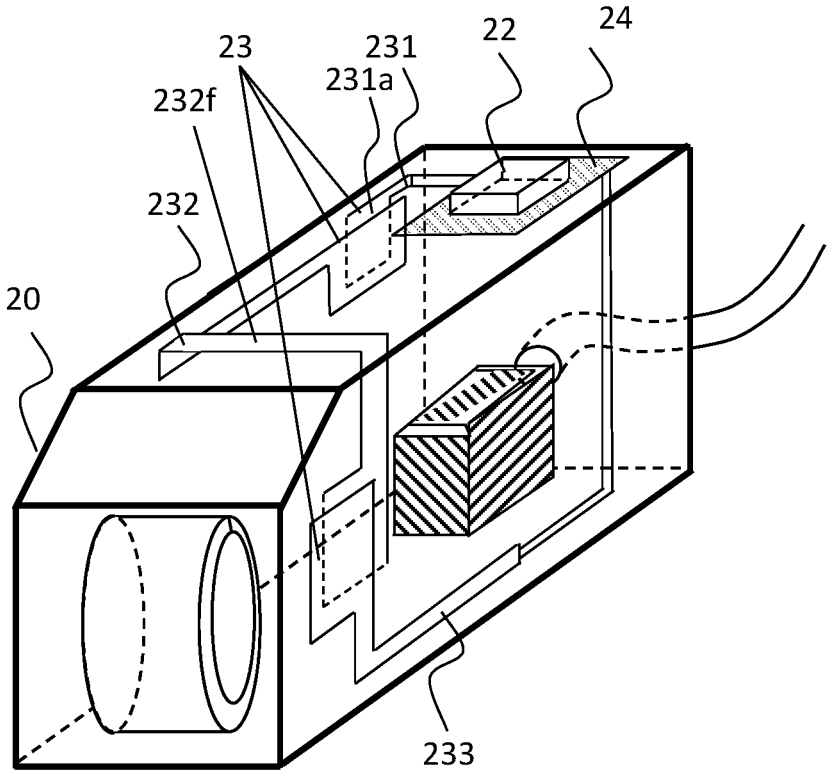
FIG. 2 shows a behind-the-ear hearing aid having an antenna system according to an embodiment of the present disclosure.

FIG. 2 shows an exemplary behind-the-ear hearing aid having an antenna system 23 according to one embodiment of the present disclosure. The hearing aid comprises an assembly 20. The assembly 20 comprises a wireless communication unit 22 for wireless communication, an antenna system 23 for emission and/or reception of an electromagnetic field. The wireless communication unit 22 may connect to a hearing aid signal processor (not shown). The wireless communication unit 22 is connected to the antenna system 23, for communicating with e.g. external devices, or with another hearing aid, located at another ear, in a binaural hearing aid system. The antenna system 23 comprises a first feeding structure 231 and a radiating segment 232. The first feeding structure 231 is connected or coupled to the wireless communication unit 22. The radiating segment 232 is adjacent to and galvanic disconnected from at least a part of the first feeding structure 231. At least a part 231*a* of the first feeding structure 231 is adjacent to and galvanic disconnected from a first end of the radiating segment 232. The radiating segment 232 is passively excited proximate a first end of the radiating segment 232 by the first feeding structure 231. The first feeding structure 231 and the first end of the radiating segment 232 are placed proximate each other and have a geometry such that a non-zero capacitance is formed. The radiating segment 232 is galvanic disconnected from part 231*a* of the first feeding structure 231 if a capacitive coupling between them is between 1 pF and 10 pF, such as between 1 pF and 5 pF. The radiating segment 232 is galvanic disconnected from the part 231*a* of the first feeding structure 231 if a distance between them is between 0.05 mm and 0.3 mm. The geometry of the first feeding structure and of the radiating segment and/or the distance between them has to be chosen such that the capacitance is between 1 pF and 10 pF. The radiating segment 232 is an electrically floating segment. The radiating segment 232 is e.g. a floating element in that it is galvanic disconnected from the wireless communication unit 22 or a ground. The floating element may have no ohmic contact to the wireless communication unit 22 or a ground. The radiating segment 232 is capacitively coupled to the first feeding structure 231. The radiating segment 232 may be galvanic disengaged or separated from the first feeding structure 231. The radiating segment 232 and the first feeding structure 231 experience for example contactless conductivity of energy between them. The radiating segment 232 and the first feeding structure 231 exchange energy through capacitance. At least a part 231*a* of the first feeding structure 231 is provided in a first plane and at least a part of the radiating segment 232 is provided in a second plane, as seen in the figure the first plane and the second plane extend in the plane of the first feeding structure and the radiating segment, respectively. The first plane is different from the second plane. The antenna system 23 comprises a second feeding structure 233. The second feeding structure 233 excites the radiating segment 232 proximate a second end. The second feeding structure 233 is coupled or connected to the wireless communication unit 22 or a ground plane 24. This may provide a balanced mode where the impedance seen into the first feeding structure 231 and the impedance seen into the second feeding structure 233 are balanced around a ground plane 24. The hearing aid assembly 20 comprises a first side and a second side. The first side is opposite the second side. The first side of the hearing aid assembly and/or the second side of the hearing aid assembly extends along a longitudinal axis of the hearing aid assembly 20. The radiating segment may be provided substantially along a first side of the hearing aid assembly. The second side is adjacent the head of a user when the hearing aid is worn in its intended operational position behind the ear. A midpoint 232*f* of the radiating segment 232 is located at a part of the radiating segment that extends between the first side and the second side.

Figure 3:
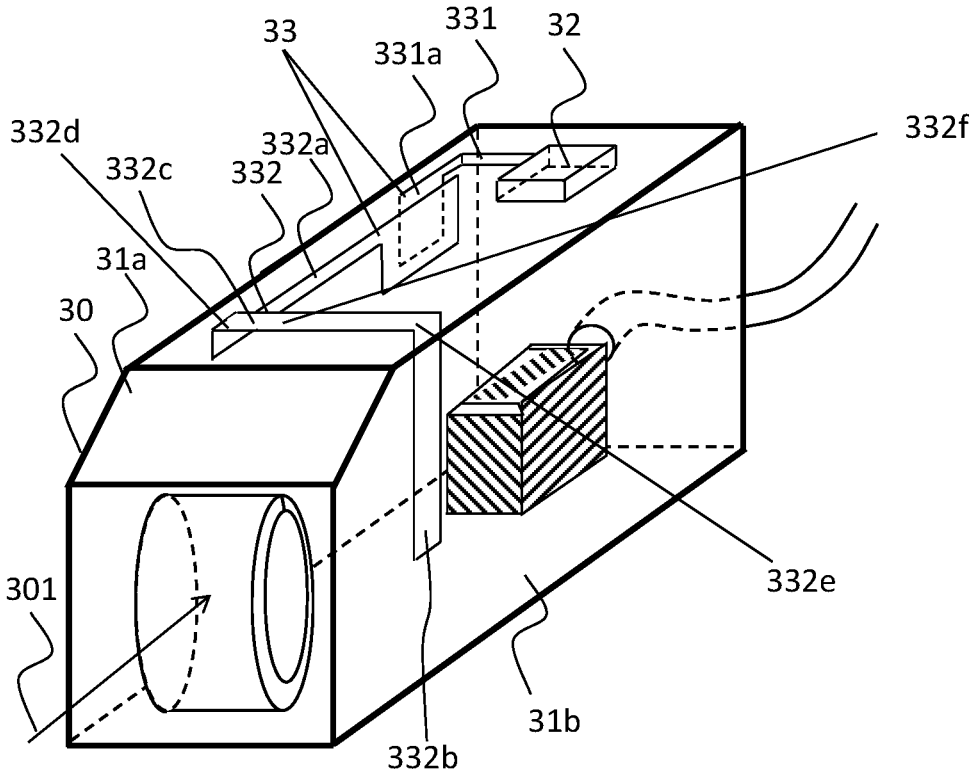
FIG. 3 shows a behind-the-ear hearing aid having an antenna system according to a further embodiment of the present disclosure.

FIG. 3 shows an exemplary behind-the-ear hearing aid having an antenna system 33 according to one embodiment of the present disclosure. The hearing aid comprises an assembly 30. The assembly 30 comprises a wireless communication unit 32 for wireless communication, an antenna system 33 for emission and/or reception of an electromagnetic field. The wireless communication unit 32 may connect to a hearing aid signal processor. The wireless communication unit 32 is connected to the antenna system 33, for communicating with e.g. external devices, or with another hearing aid, located at another ear, in a binaural hearing aid system. The antenna system 33 comprises a first feeding structure 331 and a radiating segment 332. The first feeding structure 331 is connected or coupled to the wireless communication unit 32. The radiating segment 332 is adjacent to and galvanic disconnected from the first feeding structure 331. The first feeding structure 331 is adjacent to and galvanic disconnected from a first end of the radiating segment 332. The radiating segment 332 is passively excited proximate a first end of the radiating segment 332 by the first feeding structure 331. A second end of the radiating segment 332 is a free end or an open end. The radiating segment 332 is galvanic disconnected from at least a part 331*a* of the first feeding structure 331 if a capacitive coupling between them is between 1 pF and 10 pF, such as between 1 pF and 5 pF. The radiating segment 332 is galvanic disconnected from a part 331*a* of the first feeding structure 331 if a distance between them is between 0.05 mm and 0.3 mm. The radiating segment 332 is an electrically floating segment. The radiating segment 332 is e.g. a floating element in that it is galvanic disconnected from the wireless communication unit 32 or a ground. The radiating segment 332 is capacitively fed or coupled to the first feeding structure 331. The radiating segment 332 may be galvanic disengaged or separated from at least a part 331*a* of the first feeding structure 331. The radiating segment 332 and the part 331*a* of the first feeding structure 331 experience for example contactless transmission of energy between them. The radiating segment 332 and a part 331*a* of the first feeding structure 331 exchange energy through capacitance. At least a part 331*a* of the first feeding structure 331 is provided in a first plane and at least a part 332*a* of the radiating segment 332 is provided in a second plane. The first plane is different from the second plane. The hearing aid assembly 30 comprises a first side 31*a* and a second side 31*b*. The first side 31*a* is opposite the second side 31*b*. The first side 31*a* of the hearing aid assembly 30 and/or the second side 31*b* of the hearing aid assembly extends along a longitudinal axis of the hearing aid assembly 30. A first section 332*a* of the radiating segment 332 is provided along a first side of the hearing aid assembly. A second section 332*b* of the radiating segment 332 is provided along a second side of the hearing aid assembly. A third section 332*c* of the radiating segment 332 is connected to the first section 332*a* in a first end 332*d* of the third section 332*c* and to a second section 332*b* in the second end 332*e* of the third section 332*c*. The third section 332*c* extends along an axis which is normal+/−25° to the first side 31*a* and/or the second side 31*b* of the hearing aid assembly 30. The third section 332*c* extends for example along an axis which is normal+/−25° to a surface of a head of a user when the hearing aid is worn in its operational position. A length of the radiating segment may be greater than ½λ and less than λ, λ being the wavelength of an electromagnetic field emitted by the antenna system. For example, an effective length of the antenna structure is ¾λ. A point 332*f* of the radiating segment 332 that is located at a distance of ½λ from the first end of the radiating segment 332 is provided at a part of the radiating segment that extends between a first side and a second side of the hearing aid, such as on the third section 332*c* of the radiating segment 332.

Figure 4:
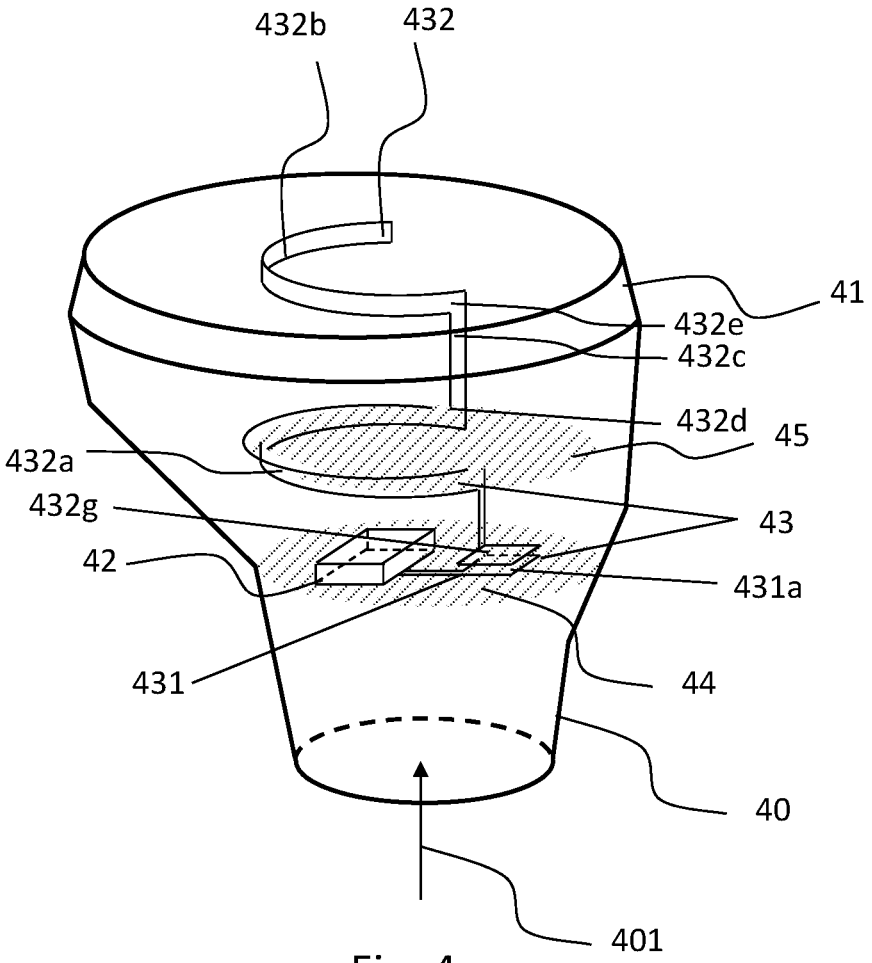
FIG. 4 shows an in-the-ear hearing aid having an antenna system according to one embodiment of the present disclosure.

FIG. 4 shows an in-the-ear (ITE) hearing aid having an antenna system according to one embodiment of the present disclosure. The hearing aid comprises an assembly 40. The assembly 40 comprises a wireless communication unit 42 for wireless communication, an antenna system 43 for emission and/or reception of an electromagnetic field. The wireless communication unit 42 may connect to a hearing aid signal processor. The wireless communication unit 42 is connected to the antenna system 43, for communicating with e.g. external devices, or with another hearing aid, located at another ear, in a binaural hearing aid system. The antenna system 43 comprises a first feeding structure 431 and a radiating segment 432. The first feeding structure 431 is connected or coupled to the wireless communication unit 42. The radiating segment 432 is adjacent to and galvanic disconnected from at least a part 431*a* of the first feeding structure 431. The at least part 431*a* of the first feeding structure 431 is adjacent to and galvanic disconnected from a first end of the radiating segment 432. The radiating segment 432 is passively excited proximate a first end of the radiating segment 432 by the part 431*a* of the first feeding structure 431. A second end of the radiating segment 432 is a free end or an open end. A current at the second end of the radiating segment 432 is zero. The radiating segment 432 is galvanic disconnected from part 431*a* of the first feeding structure 431 if a capacitive coupling between them is between 1 pF and 10 pF, such as between 1 pF and 5 pF. The radiating segment 432 is galvanic disconnected from part 431*a* of the first feeding structure 431 if a distance between them is between 0.05 mm and 0.3 mm. The radiating segment 432 is an electrically floating segment. The radiating segment 432 is e.g. a floating element in that it is galvanic disconnected from part 431*a* of the first feeding structure 431, or the wireless communication unit 42 or a ground. The radiating segment 432 is capacitively fed or coupled to the first feeding structure 431. The radiating segment 432 may be galvanic disengaged or separated from the first feeding structure 431. The radiating segment 432 and part 431*a* of the first feeding structure 431 experience for example contactless transmission of energy between them. The radiating segment 432 and part 431*a* of the first feeding structure 431 exchange energy through capacitance. At least a part 431*a* of the first feeding structure 431 is provided in a first plane 44 and at least a part 432*a* of the radiating segment 432 is provided in a second plane 45. The first plane 44 is different from the second plane 45. The hearing aid assembly 40 comprises a face plate 41. A first section 432*a* of the radiating segment 432 is provided in a first ITE plane adjacent a face plate 41 of an ITE hearing aid. A second section 432*b* of the radiating segment 432 is provided in a second ITE plane. A third section 432*c* of the radiating segment 432 is connected to the first section 432*a* in a first end 432*d* and to the second section 432*b* in a second end 432*e*. A part of the first section 432*a* is provided in a plane parallel to the face plate 41. A part of the second section 432*b* is provided in a plane parallel to the face plate 41. The second ITE plane is substantially parallel with the first ITE plane. A part of the third section 432*c* is provided in a plane orthogonal+/−25 degrees to the face plate 41. The third section 432*c* is provided along an axis which is normal+/−25° to the face plate 41. A midpoint of the radiating segment 432 is located at a part 432*c* of the radiating segment 432 that extends in a direction orthogonal to the face plate 41 within +/−25 degrees, such as the third section 432*c*. A distance from the end 432*g* of the radiating segment 432 that is capacitively coupled with the first feeding structure, to the midpoint of the radiating segment is for example in the range of ¼ of a wavelength of the electromagnetic field emitted by the antenna system.

Figure 5A:
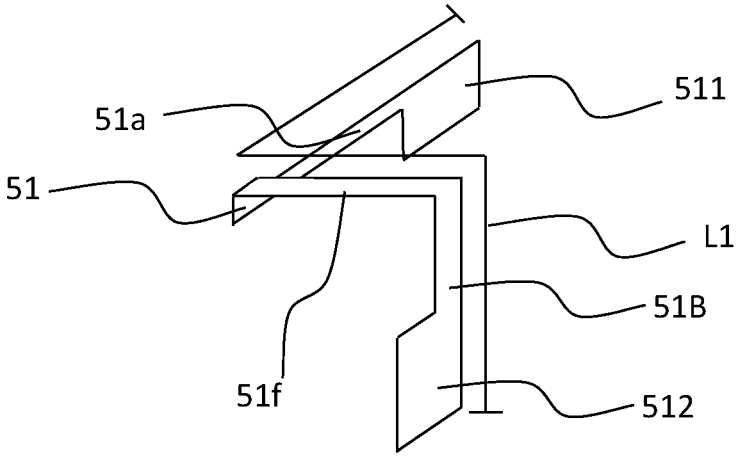
FIG. 5*a* shows schematically an exemplary antenna structure for a hearing aid according to the present disclosure.

FIG. 5*a* shows schematically an exemplary antenna structure for a hearing aid according to the present disclosure. An effective length L1 of the radiating segment 51 is between ¼ of a wavelength of an electromagnetic field emitted by the antenna system and a full wavelength, such as between and ¼ and ¾ of a wavelength of an electromagnetic field emitted by the antenna system. For example, the length L1 of the radiating segment 51 is half a wavelength of electromagnetic field emitted by the antenna system. A current flowing into the radiating segment 51 reaches a maximum at a distance from the first end of ¼ of a wavelength of the electromagnetic field emitted by the antenna system. When for example the length of the radiating segment 51 is half a wavelength of the electromagnetic field emitted by the antenna system, the current flowing into the radiating segment 51 may reach a maximum at a midpoint 51*f* of the radiating segment. Such a midpoint 51*f* of the radiating segment 51 is preferably located at a section of the radiating segment 51 that is normal+/−25 degrees to a surface of a head of a user when the hearing aid is worn in its operational position (e.g. section 332*c* of FIG. 3, or section 432*c* of FIG. 4).

The radiating segment 51 is fed in a first end 511 and a second end 512, and the section 51*a*, 51*b* indicates a part of the radiating segment which couples capacitively with at least a part of the feeding structure (not shown), in the first end 511 and the second end 512 of the radiating segment 51, respectively.

Figure 5B:
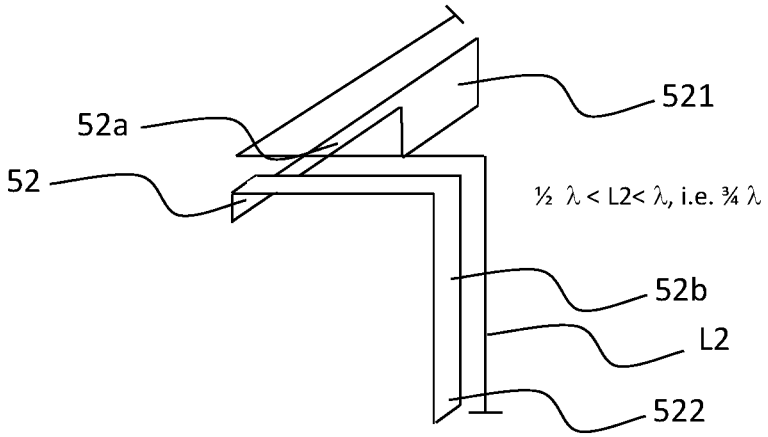
FIG. 5*b* shows schematically another exemplary antenna structure for a hearing aid according to the present disclosure.

FIG. 5*b* shows schematically another exemplary antenna structure for a hearing aid according to the present disclosure. An effective length L2 of the radiating segment 52 is between ¼ and ¾ of a wavelength of an electromagnetic field emitted by the antenna system. For example, the length L2 of the radiating segment 52 is half a wavelength of electromagnetic field emitted by the antenna system. A current flowing into the radiating segment 52 reaches a maximum at a distance from the first end of ¼ of a wavelength of the electromagnetic field emitted by the antenna system.

The radiating segment 52 is fed in a first end 521 while the other end 522 is a free end, and the section 52*a* indicates a part of the radiating segment which couples capacitively with at least a part of the feeding structure (not shown).

Figure 6A:
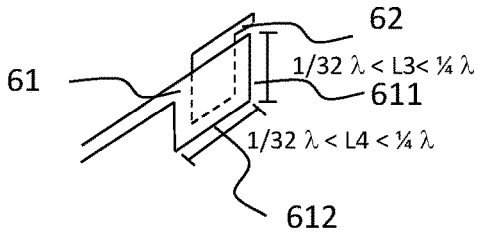
FIG. 6*a* shows schematically an exemplary quadrilateral geometry of a first end of a radiating segment and a first feeding structure according to the present disclosure.

FIG. 6*a* shows schematically an exemplary quadrilateral geometry of a first end of a radiating segment 62 and a first feeding structure 61 according to the present disclosure. The first feeding structure 61 is capacitively coupled to the radiating segment 62 over an area between 1/32 and ¼ of a wavelength of an electromagnetic field emitted by the antenna system. The first feeding structure 61 has a quadrilateral geometry with each side having a length L3, L4 between 1/32 and ¼ of a wavelength of an electromagnetic field emitted by the antenna system. The first feeding structure 61 may have a rectangular geometry with a first side 611 having a length L3 between 1/32 and ¼ of a wavelength of an electromagnetic field emitted by the antenna system and a second side 612 having a length L4 between 1/32 and ¼ of a wavelength of an electromagnetic field emitted by the antenna system. The first feeding structure 61 may have a square geometry with a side having a length between 1/32 and ¼ of a wavelength of an electromagnetic field emitted by the antenna system. The radiating segment 62 has a quadrilateral geometry with each side having a length between 1/32 and ¼ of a wavelength of an electromagnetic field emitted by the antenna system. The radiating segment 62 may have a rectangular geometry with a first side having a length between 1/32 and ¼ of a wavelength of an electromagnetic field emitted by the antenna system and a second side having a length between 1/32 and ¼ of a wavelength of an electromagnetic field emitted by the antenna system. The radiating segment 62 may have a square geometry with a side having a length between 1/32 and ¼ of a wavelength of an electromagnetic field emitted by the antenna system.

Figure 6B:
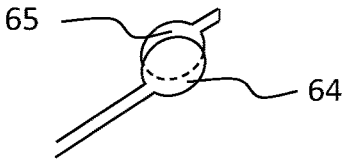
FIG. 6*b* shows schematically an exemplary round geometry of a first end of a radiating segment and a first feeding structure according to the present disclosure.

FIG. 6*b* shows schematically an exemplary round geometry of a first end of a radiating segment 64 and a first feeding structure 65 according to the present disclosure. The first feeding structure 65 is capacitively coupled to the radiating segment 64 over an area of between 1/32 and ¼ of a wavelength of an electromagnetic field emitted by the antenna system. The first feeding structure 65 has a round geometry, such as a circle, a sphere, an ellipse, and/or a rounded rectangle. The first feeding structure 65 has a round geometry with a transverse diameter having a length between 1/32 and ¼ of a wavelength of an electromagnetic field emitted by the antenna system and a conjugate diameter having a length between 1/32 and ¼ of a wavelength of an electromagnetic field emitted by the antenna system. The first feeding structure 65 may be a circle with a diameter having a length between 1/32 and ¼ of a wavelength of an electromagnetic field emitted by the antenna system. The radiating segment 64 has a round geometry with a transverse diameter having a length between 1/32 and ¼ of a wavelength of an electromagnetic field emitted by the antenna system and a conjugate diameter having a length between 1/32 and ¼ of a wavelength of an electromagnetic field emitted by the antenna system. The radiating segment 64 may be a circle with a diameter having a length between 1/32 and ¼ of a wavelength of an electromagnetic field emitted by the antenna system.

Figure 6C:
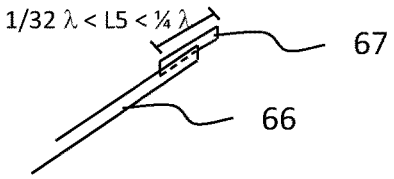
FIG. 6*c* shows schematically an exemplary wire geometry of a first end of a radiating segment and a first feeding structure according to the present disclosure.

FIG. 6*c* shows schematically an exemplary wire geometry of a first end of a radiating segment 66 and a first feeding structure 67 according to the present disclosure. The first feeding structure 67 is capacitively coupled to the radiating segment 66 over an area of between 1/32 and ¼ of a wavelength of an electromagnetic field emitted by the antenna system. The first feeding structure 67 has a length between 1/32 and ¼ of a wavelength of an electromagnetic field emitted by the antenna system and a conjugate diameter having a length L5 between 1/32 and ¼ of a wavelength of an electromagnetic field emitted by the antenna system. The first feeding structure 67 may be less than ¼ of a wavelength of an electromagnetic field emitted by the antenna system. The first feeding structure 37 is between 1/16 wavelength and ¼ wavelength. However, a geometry of the first feeding structure and a geometry of the radiating segment are designed such that a capacitive coupling between the first feeding structure and the radiating segment is between 1 pF and 10 pF.

Figure 6D:
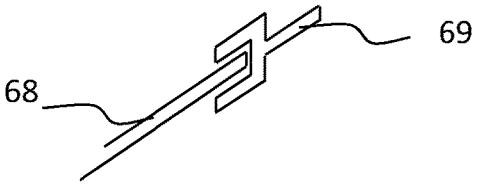
FIG. 6*d* shows schematically an exemplary fork geometry of a first end of a radiating segment and a first feeding structure according to the present disclosure.

FIG. 6*d* shows schematically an exemplary fork geometry of a first end of a radiating segment 68 and a first feeding structure 69 according to the present disclosure. The first feeding structure 69 is capacitively coupled to the radiating segment 68 over an area of between 1/32 and 1/4 of a wavelength of an electromagnetic field emitted by the antenna system. The first feeding structure 69 surrounds the radiating segment 68 along two sides and an end part of the radiating segment 68. In the present example, it is seen that the first feeding structure 69 and a part of the radiating segment 68 are co-planar.

It is understood for a person skilled in the art that the design of the feeding structures coupling to the radiating segments may be designed in any shapes or forms configured for coupling energy between the feeding structure and the radiating segment. Even though the coupling parts in the present examples have same or similar shapes and forms, it is envisaged that the shape and forms of the feeding structures 61, 65, 67, 69 may be different from the shapes and forms of the radiating segments 62, 64, 66, 68.

Figure 7A:
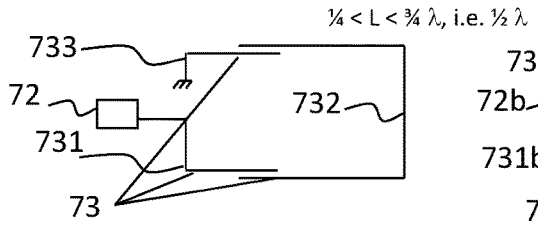
FIGS. 7*a*-7*e* show schematically various embodiments of antenna structures for a hearing aid according to the present disclosure.

FIGS. 7*a-e* show schematically various embodiments of antenna structures for a hearing aid according to the present disclosure. FIG. 7*a* shows schematically an embodiment of an antenna structure 73 of a hearing aid according to this disclosure. The antenna system 73 comprises a first feeding structure 731, a radiating element 732, and a third segment 733. The first feeding structure 731 is connected to a wireless communication unit 72. The third segment 733 is connected to a ground plane. The radiating segment 732 is adjacent to and galvanic disconnected from at least a part of the first feeding structure 731. The at least part of the first feeding structure 731 is adjacent to and galvanic disconnected from a first end of the radiating segment 732. The radiating segment 732 is capacitively coupled or passively excited proximate a first end of the radiating segment 732 by the at least part of the first feeding structure 731. The radiating segment 732 is adjacent to and galvanic disconnected to at least a part of the third segment 733. The at least part of the third segment 733 is adjacent to and galvanic disconnected from a second end of the radiating segment 732. The radiating segment 732 is passively coupled proximate a second end of the radiating segment 732 by the third segment 733.

Figure 7B:
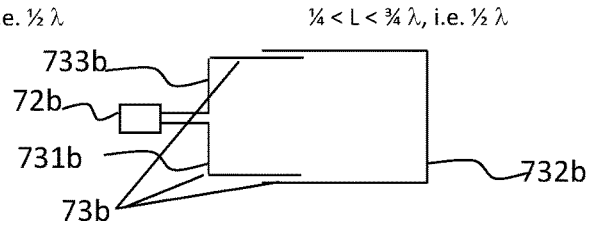

FIG. 7*b* shows schematically an embodiment of an antenna structure 73*b* of a hearing aid according to this disclosure. The antenna system 73*b* comprises a first feeding structure 731*b*, a radiating element 732*b*, and a second feeding structure 733*b*. The first feeding structure 731*b* is connected to a wireless communication unit 72*b*. The second feeding structure 733*b* is connected to the wireless communication unit 72*b*. The radiating segment 732*b* is adjacent to and galvanic disconnected from a part of the first feeding structure 731*b*. The first feeding structure 731*b* is adjacent to and galvanic disconnected from a first end of the radiating segment 732*b*. The radiating segment 732*b* is passively excited proximate a first end of the radiating segment 732*b* by the first feeding structure 731*b*. The radiating segment 732*b* is adjacent to and galvanic disconnected to the second feeding structure 733*b*, or a part of the second feeding structure. The second feeding structure 733*b* is adjacent to and galvanic disconnected from a second end of the radiating segment 732*b*. The radiating segment 732*b* is passively coupled proximate a second end of the radiating segment 732*b* by the second feeding structure 733*b*. The antenna system 73*b* may be a balanced antenna system.

Figure 7C:
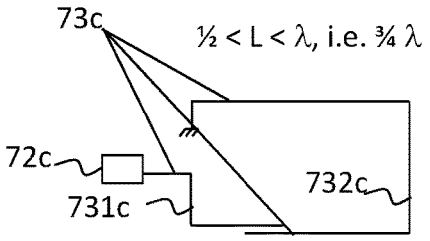

FIG. 7*c* shows schematically an embodiment of an antenna structure 73*c* of a hearing aid according to this disclosure. The antenna system 73*c* comprises a first feeding structure 731*c*, a radiating element 732*c*. The first feeding structure 731*c* is connected to a wireless communication unit 72*c*. The radiating segment 732*c* is adjacent to and galvanic disconnected from the first feeding structure 731*c*. The first feeding structure 731*c* is adjacent to and galvanic disconnected from a first end of the radiating segment 732*c*. The radiating segment 732*c* is passively excited proximate a first end of the radiating segment 732*c* by the first feeding structure 731*c*. The second end of the radiating segment 732*c* is grounded. The radiating segment 732*c* can be construed as a parasitic element since it is connected to a ground plane.

Figure 7D:
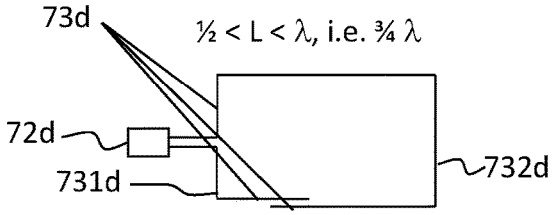

FIG. 7*d* shows schematically an embodiment of an antenna structure 73*d* of a hearing aid according to this disclosure. The antenna system 73*d* comprises a first feeding structure 731*d*, a radiating element 732*d*. The first feeding structure 731*d* is connected to a wireless communication unit 72*d*. The radiating segment 732*d* is adjacent to and galvanic disconnected from at least a part of the first feeding structure 731*d*. The first feeding structure 731*d* is adjacent to and galvanic disconnected from a first end of the radiating segment 732*d*. The radiating segment 732*d* is passively excited proximate a first end of the radiating segment 732*d* by the first feeding structure 731*d*. The second end of the radiating segment 732*d* is connected to the wireless communication unit 72*d*.

Figure 7E:
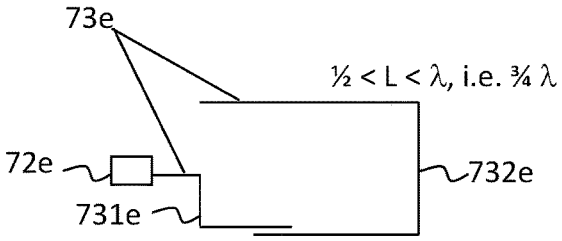

FIG. 7*e* shows schematically an embodiment of an antenna structure 73*e* of a hearing aid according to this disclosure. The antenna system 73*e* comprises a first feeding structure 731*e*, and a radiating element 732*e*. The first feeding structure 731*e* is connected to a wireless communication unit 72*e*. The radiating segment 732*e* is adjacent to and galvanic disconnected from at least a part of the first feeding structure 731*e*. The at least part of the first feeding structure 731*e* is adjacent to and galvanic disconnected from a first end of the radiating segment 732*e*. The radiating segment 732*e* is passively excited proximate a first end of the radiating segment 732*e* by the first feeding structure 731*e*. The second end of the radiating segment 732*e* is a free end. In this embodiment, there is no balanced mode. The antenna system 73*e* may be construed as a monopole antenna.

Currents flowing in the parts of the antenna system 23, 33, 43, in a direction orthogonal to the surface of the head, such as in the parts 332*c*, 432*c* contribute significantly to the electromagnetic field radiated by the antenna. The part of the antenna extending orthogonally to the face plate in an ITE hearing or to the first side in a BTE hearing is orthogonal to the surface of the head. This part of the antenna contributes to an electromagnetic field that travels around the head of the user thereby providing a wireless data communication that is robust and has low loss.

It is envisaged that for any embodiment any radiating segment may be galvanic disconnected from at least a part of the first feeding structure. Any radiating segment may additionally be adjacent to at least a part of the first feeding structure.

Figure 8:
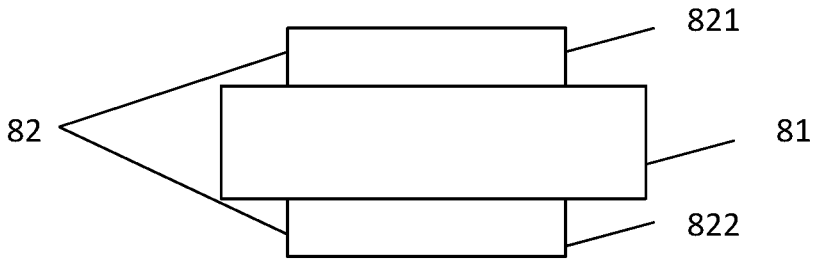
FIG. 8 shows schematically an exemplary arrangement of an antenna system with respect to a hearing aid shell.

FIG. 8 shows schematically an exemplary arrangement 80 of an antenna system 82 with respect to a hearing aid shell 81. The arrangement 80 comprises a hearing aid shell 81, and an antenna system 82. The antenna system 82 comprises a first feeding structure, and a radiating segment (not entirely shown). In one or more embodiments, at least a part 822 of the radiating segment is provided at or in a hearing aid shell 81. In one or more embodiments, at least a part 822 of the radiating segment is provided on an inner or an outer surface of the hearing aid shell 81. For example the hearing aid shell 81 is manufactured in a low loss material, such as in a material having a tangent loss of below 0.05, such as below 0.02, such as in a material of plastic, ABS Polycarbonate, PCABS, Zytel, ceramics, etc. For example, a part 821 of the first feeding structure is glued against an internal e.g. plastic frame while a part 822 of the radiating segment is placed in outer surface of the hearing shell. Alternatively, a part 821 of the first feeding structure is glued against an internal e.g. plastic frame while a part 822 of the radiating segment is placed inside the e.g. plastic hearing shell. Another example involves placing the first feeding structure against an internal e.g. plastic frame and the radiating segment inside the hearing aid shell as a metal insert mold. In yet another example, the first feeding structure and the radiating segment are stacked on the same flex print with a certain thickness of e.g. polyimide dielectric material used in PCB flex print material and placed against an internal e.g. plastic frame of the hearing aid.

The use of the terms "first", "second", and the like does not imply any particular order, but they are included to identify individual elements. Moreover, the use of the terms first, second, etc. does not denote any order or importance, but rather the terms first, second, etc. are used to distinguish one element from another. Note that the words first and second are used here and elsewhere for labelling purposes only and are not intended to denote any specific spatial or temporal ordering. Furthermore, the labelling of a first element does not imply the presence of a second element Also disclosed are hearing aids according to any of the following items:

Item 1. A hearing aid comprising an assembly, the assembly comprising:

a microphone for reception of sound and conversion of the received sound into a corresponding first audio signal, a signal processor for processing the first audio signal into a second audio signal compensating a hearing loss of a user of the hearing aid, a wireless communication unit configured for wireless communication an antenna system comprising a first feeding structure and a radiating segment, and wherein the first feeding structure is connected or coupled to the wireless communication unit, and wherein the radiating segment is adjacent to and galvanic disconnected from at least a part of the first feeding structure.

Item 2. A hearing aid according to item 1, wherein the at least part of the first feeding structure is galvanic disconnected from the radiating segment if a capacitive coupling between the at least part of the first feeding structure and the radiating segment is between 1 pF and 10 pF.

Item 3. A hearing aid according to any of the previous items, wherein the at least part of the first feeding structure is galvanic disconnected from the radiating segment if the distance between the at least part of the first feeding structure and the radiating segment is between 0.05 mm and 0.3 mm.

Item 4. A hearing aid according to any of the previous items, wherein the at least part of the first feeding structure is adjacent to and galvanic disconnected from a first end of the radiating segment.

Item 5. A hearing aid according to any of items 2-3, wherein the at least part of the first feeding structure is capacitively coupled to the radiating segment over an area between 1/32 and 1/4 of a wavelength of an electromagnetic field emitted by the antenna system.

Item 6. A hearing aid according to any of the previous items, wherein the effective length of the radiating segment is between 1/4 of a wavelength and a full wavelength of an electromagnetic field emitted by the antenna system.

Item 7. A hearing aid according to any of the previous items, wherein a current flowing into the radiating segment reaches a maximum at a distance from the first end of 1/4 of a wavelength of the electromagnetic field emitted by the antenna system.

Item 8. A hearing aid according to any of the previous items, wherein a length of the first feeding structure is less than 1/4 of a wavelength of an electromagnetic field emitted by the antenna system.

Item 9. A hearing aid according to any of the previous items, wherein a length of the first feeding structure is between 1/16 of a wavelength and 1/4 of a wavelength of an electromagnetic field emitted by the antenna system.

Item 10. A hearing aid according to any of the previous items, wherein the radiating segment is an electrically floating segment.

Item 11. A hearing aid according to any of the previous items, wherein at least a part of the first feeding structure is provided in a first plane and wherein at least a part of the radiating segment is provided in a second plane.

Item 12. A hearing aid according to item 4, wherein the first plane is different from the second plane.

Item 13. A hearing aid according to any of items 1-4, wherein a part of the first feeding structure and a part of the radiating segment are co-planar.

Item 14. A hearing aid according to any of the previous items, wherein the radiating segment has one free end or two free ends.

Item 15. A hearing aid according to any of the previous items, wherein a first section of the radiating segment is provided along a first side of the hearing aid assembly, a second section of the radiating segment is provided along a second side of the hearing aid assembly, and a third section of the radiating segment is connected to the first section in a first end and to a second section in the second end.

Item 16. A hearing aid according to item 7, wherein the first side of the hearing aid assembly and/or the second side of the hearing aid assembly extends along a longitudinal axis of the hearing aid.

Item 17. A hearing aid according to items 7 or 8, wherein the third section extends along an axis which is normal+/−25° to the first side and/or the second side of the hearing aid assembly.

Item 18. A hearing aid according to any of items 1-6, wherein a first section of the radiating segment is provided in a first in-the-ear plane adjacent a face plate of an in-the-ear hearing aid, and wherein a second section of the radiating segment is provided in a second in-the-ear plane, and wherein a third section of the radiating segment is connected to the first section in a first end and to the second section in a second end.

Item 19. A hearing aid according to item 9, wherein the third section is provided along an axis which is normal+/−25° to the face plate.

Item 20. A hearing aid according to item 10, wherein the second in-the-ear plane is substantially parallel with the first in-the-ear plane.

Item 21. A hearing aid according to any of items 1-6, wherein the radiating segment is provided substantially along a first side of the hearing aid assembly.

Item 22. A hearing aid according to any of the previous items, wherein at least a part of the radiating segment is provided at or in a hearing aid shell.

Item 23. A hearing aid according to item 22, wherein at least a part of the radiating segment is provided on an inner or an outer surface of the hearing aid shell.

Item 24. A hearing aid according to items 22-23, wherein the hearing aid shell is manufactured in a low loss material, such as in a material having a tangent loss of below 0.05, such as below 0.02, such as in a material of plastic, ABS Polycarbonate, PCABS, Zytel, ceramics, etc.

Item 25. A hearing aid according to any of the previous items, wherein the antenna system further has a third segment, the third segment being connected to the wireless communication unit and wherein at least a part of the third segment is adjacent to and galvanic disconnected from a second end of the radiating segment.

Item 26. A hearing aid according to any items 1-24, wherein the antenna system further has a third segment, the third segment being connected to a ground plane and wherein at least a part of the third segment is adjacent to and galvanic disconnected from a second end of the radiating segment.

Item 27. A hearing aid according to any of the previous items, wherein at least a part of the first feeding structure is adjacent to and galvanic disconnected from a first end of the radiating segment and wherein a second end of the radiating segment is grounded.

Although particular embodiments have been shown and described, it will be understood that it is not intended to limit the claimed inventions to the preferred embodiments, and it will be obvious to those skilled in the art that various changes and modifications may be made without departing from the spirit and scope of the claimed inventions. The specification and drawings are, accordingly, to be regarded in an illustrative rather than restrictive sense. The claimed inventions are intended to cover alternatives, modifications, and equivalents.

The invention claimed is:

1. A hearing aid comprising an assembly, the assembly comprising:

a microphone for reception of sound and conversion of the received sound into a corresponding first audio signal;

a signal processor configured to provide a second audio signal compensating a hearing loss of a user of the hearing aid, wherein the second audio signal is based on the first audio signal;

a wireless communication unit; and an antenna system comprising a first feeding structure and a radiating segment;

wherein the first feeding structure is connected or coupled to the wireless communication unit; and wherein at least a part of the first feeding structure is galvanically disconnected from the radiating segment, and is capactively coupled to the radiating segment;

wherein the hearing aid further comprises a first side and a second side that is opposite the first side, wherein a first section of the radiating segment is located closer to the first side than the second side, wherein a second section of the radiating segment is located closer to the second side than the first side, wherein a third section of the radiating segment is between the first section and the second section; and wherein the first section of the radiating segment forms a first angle with respect to the third section of the radiating segment, and the second section of the radiating segment forms a second angle with respect to the third section of the radiating segment.

2. A hearing aid comprising an assembly, the assembly comprising:

a microphone for reception of sound and conversion of the received sound into a corresponding first audio signal;

a signal processor configured to provide a second audio signal compensating a hearing loss of a user of the hearing aid, wherein the second audio signal is based on the first audio signal;

a wireless communication unit; and an antenna system comprising a first feeding structure and a radiating segment;

wherein the first feeding structure is connected or coupled to the wireless communication unit;

wherein at least a part of the first feeding structure is galvanically disconnected from the radiating segment, and is capactively coupled to the radiating segment; and wherein the hearing aid further comprises a faceplate, wherein a first section of the radiating segment is in a first plane parallel to the face plate, wherein a second section of the radiating segment is in a second plane, and wherein a third section of the radiating segment is between the first section and the second section.

3. The hearing aid according to claim 2, wherein a capacitive coupling between the at least a part of the first feeding structure and the radiating segment is at least 0.5 pF.

4. The hearing aid according to claim 2, wherein a distance between the at least a part of the first feeding structure and the radiating segment is between 0.05 mm and 0.3 mm.

5. The hearing aid according to claim 2, wherein an effective length of the radiating segment is between ¼ of a wavelength and a full wavelength of an electromagnetic field emitted by the antenna system.

6. The hearing aid according to claim 2, wherein a current flowing into the radiating segment reaches a maximum at a distance from a first end of ¼ of a wavelength of an electromagnetic field emitted by the antenna system.

7. The hearing aid according to claim 2, wherein a length of the first feeding structure is less than ¼ of a wavelength of an electromagnetic field emitted by the antenna system.

8. The hearing aid according to claim 2, wherein the radiating segment comprises an electrically floating segment.

9. The hearing aid according to claim 2, wherein the first plane is parallel to the second plane.

10. The hearing aid according to claim 2, wherein the radiating segment has a free end.

11. The hearing aid according to claim 2, wherein a portion of the radiating segment is at or in a hearing aid shell.

12. The hearing aid according to claim 2, wherein a capacitive coupling between the at least a part of the first feeding structure and the radiating segment is less than 20 pF.

13. The hearing aid according to claim 2, wherein the third section of the radiating segment that is between the first section and the second section extends along an axis forming an angle with respect to an ear axis, the angle being 0°+/−25°.

14. A hearing aid comprising an assembly, the assembly comprising:

a microphone for reception of sound and conversion of the received sound into a corresponding first audio signal;

a signal processor configured to provide a second audio signal compensating a hearing loss of a user of the hearing aid, wherein the second audio signal is based on the first audio signal;

a wireless communication unit; and an antenna system comprising a first feeding structure and a radiating segment;

wherein the first feeding structure is connected or coupled to the wireless communication unit;

wherein at least a part of the first feeding structure is galvanically disconnected from the radiating segment, and is capactively coupled to the radiating segment; and wherein the hearing aid further comprises a faceplate, wherein the radiating segment comprises a first section, a second section, and a third section between the first section and the second section, and wherein the third section is along an axis forming an angle that is 90°+/−25° with respect to the faceplate.

15. The hearing aid according to claim 14, wherein a capacitive coupling between the at least a part of the first feeding structure and the radiating segment is at least 0.5 pF.

16. The hearing aid according to claim 14, wherein a distance between the at least a part of the first feeding structure and the radiating segment is between 0.05 mm and 0.3 mm.

17. The hearing aid according to claim 14, wherein an effective length of the radiating segment is between ¼ of a wavelength and a full wavelength of an electromagnetic field emitted by the antenna system.

18. The hearing aid according to claim 14, wherein a current flowing into the radiating segment reaches a maximum at a distance from a first end of ¼ of a wavelength of an electromagnetic field emitted by the antenna system.

19. The hearing aid according to claim 14, wherein a length of the first feeding structure is less than ¼ of a wavelength of an electromagnetic field emitted by the antenna system.

20. The hearing aid according to claim 14, wherein the radiating segment comprises an electrically floating segment.

21. The hearing aid according to claim 14, wherein at least a part of the first feeding structure is in a first plane and wherein at least a part of the radiating segment is in a second plane.

22. The hearing aid according to claim 21, wherein the first plane is parallel to the second plane.

23. The hearing aid according to claim 14, wherein the radiating segment has a free end.

24. The hearing aid according to claim 14, wherein the first section of the radiating segment is along a first side of the assembly, and the second section of the radiating segment is along a second side of the assembly, the first side being opposite from the second side.

25. The hearing aid according to claim 14, wherein a portion of the radiating segment is at or in a hearing aid shell.

26. The hearing aid according to claim 14, wherein the axis also forms an angle with respect to an ear axis, the angle being 0°+/−25°.

27. A hearing aid comprising an assembly, the assembly comprising:

a microphone for reception of sound and conversion of the received sound into a corresponding first audio signal;

a signal processor configured to provide a second audio signal compensating a hearing loss of a user of the hearing aid, wherein the second audio signal is based on the first audio signal;

a wireless communication unit; and an antenna system comprising a first feeding structure and a radiating segment;

wherein the first feeding structure is connected or coupled to the wireless communication unit;

wherein at least a part of the first feeding structure is galvanically disconnected from the radiating segment, and is capactively coupled to the radiating segment; and wherein a current flowing into the radiating segment reaches a maximum at a location that is at least 30% of a length of the radiating segment from an end of the radiating segment.

28. The hearing aid according to claim 27, wherein a capacitive coupling between the at least a part of the first feeding structure and the radiating segment is at least 0.5 pF.

29. The hearing aid according to claim 27, wherein a distance between the at least a part of the first feeding structure and the radiating segment is between 0.05 mm and 0.3 mm.

30. The hearing aid according to claim 27, wherein an effective length of the radiating segment is between ¼ of a wavelength and a full wavelength of an electromagnetic field emitted by the antenna system.

31. The hearing aid according to claim 27, wherein a current flowing into the radiating segment reaches a maximum at a distance from a first end of ¼ of a wavelength of an electromagnetic field emitted by the antenna system.

32. The hearing aid according to claim 27, wherein a length of the first feeding structure is less than ¼ of a wavelength of an electromagnetic field emitted by the antenna system.

33. The hearing aid according to claim 27, wherein the radiating segment comprises an electrically floating segment.

34. The hearing aid according to claim 27, wherein at least a part of the first feeding structure is in a first plane and wherein at least a part of the radiating segment is in a second plane.

35. The hearing aid according to claim 34, wherein the first plane is parallel to the second plane.

36. The hearing aid according to claim 27, wherein the radiating segment has a free end.

37. The hearing aid according to claim 27, wherein a first section of the radiating segment is along a first side of the assembly, a second section of the radiating segment is along a second side of the assembly, and a third section of the radiating segment is between the first section and the second section.

38. The hearing aid according to claim 27, wherein a portion of the radiating segment is at or in a hearing aid shell.

39. The hearing aid according to claim 27, wherein the radiating segment comprises a first section, a second section, and a third section between the first section and the second section, and wherein the third section of the radiating segment that is between the first section and the second section extends along an axis forming an angle with respect to an ear axis, the angle being 0°+/−25°.

40. The hearing aid according to claim 27, wherein the hearing aid further comprises a faceplate, wherein the radiating segment comprises a first section, a second section, and a third section between the first section and the second section, and wherein the third section is along an axis forming an angle that is 90°+/−25° with respect to the faceplate.

* * * * *